US007448493B2

(12) United States Patent
Wong

(10) Patent No.: US 7,448,493 B2
(45) Date of Patent: Nov. 11, 2008

(54) BOTTLE CARRIER

(75) Inventor: Michael P. Wong, Los Angeles, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 342 days.

(21) Appl. No.: 10/741,189

(22) Filed: Dec. 18, 2003

(65) Prior Publication Data

US 2005/0133386 A1 Jun. 23, 2005

(51) Int. Cl.
*B65D 71/50* (2006.01)

(52) U.S. Cl. ..... 206/158; 206/151; 206/161; 206/427; 294/87.2

(58) Field of Classification Search ..... 206/139, 206/168, 148, 149, 203, 145, 158, 151, 159, 206/199, 201; 294/87.2, 159
See application file for complete search history.

(56) References Cited

U.S. PATENT DOCUMENTS 3,036,853 A * 5/1962 Glazer ..... 294/87.2
3,199,908 A * 8/1965 Poupitch ..... 294/87.2
3,587,846 A * 6/1971 Heier ..... 206/151
4,360,231 A * 11/1982 Bolin ..... 294/87.2
4,634,002 A * 1/1987 Delonghi ..... 206/158
5,413,395 A * 5/1995 Stewart ..... 294/87.2
6,325,210 B1 * 12/2001 Henry, Jr. ..... 206/427
6,571,533 B2 * 6/2003 Mahood et al. ..... 53/263

* cited by examiner

*Primary Examiner*—Jila M Mohandesi
(74) *Attorney, Agent, or Firm*—Carlson Gaskey & Olds

(57) ABSTRACT

A bottle carrier includes a base and one or more arms extending downwardly from the base. The arms include an inwardly facing surface for contacting a neck of a bottle, and also include an inwardly extending tab having an upper surface for supporting a lip on the neck of the bottle. The tabs further include a lower surface angled away from the base as it extends away from the bottle. Upon insertion of a bottle into a bottle receiving area defined by the arms, the upper surface of the bottle contacts the lower surfaces of the tabs, thereby causing at least one of the arms to deflect outward, permitting insertion of the bottle cap and lip on the neck of the bottle into the bottle receiving area. Once the lip of the bottle is inserted past the tabs, the arms return toward their undeflected position, with the tabs positioned below the lip, retaining the bottle in the bottle neck receiving area.

9 Claims, 9 Drawing Sheets

40
10
20
12
14
38
40

BOTTLE CARRIER

BACKGROUND OF THE INVENTION

The present invention relates to a carrier for carrying a plurality of containers, particularly bottles.

Beverage containers, particularly plastic or glass bottles, are often shipped and sold in multi-packs, such as six, eight or twelve packs. Each bottle includes a body portion and a narrower neck portion. A lip is usually formed on the neck of the bottle below the bottle cap. The containers in the pack may be secured to one another by flexible plastic connecting the necks of each of the bottles below the lip on each neck. The plastic connecting the bottles in a multi-pack is not reusable. Once a bottle is removed from the plastic, the plastic is usually inelastically deformed such that the bottle could not be reinserted into the plastic and retained by the plastic.

SUMMARY OF THE INVENTION

The present invention provides a bottle carrier that is reusable. The bottle carrier includes a base below which is defined by one or more bottle neck receiving areas. Each bottle neck receiving area is defined by one or more arms extending downwardly from the base. The arms are arranged about an axis of the bottle neck receiving area, which coincides with an axis of a neck of a bottle when received in the bottle neck receiving area. Each of the arms includes a radially inwardly extending tab having an upper surface for supporting the lip on the neck of the bottle. A lower surface of each tab is angled away from the base as it extends away from the axis, such that upon insertion of a neck of a bottle into the bottle neck receiving area, the bottle first contacts the lower surfaces of the tabs, thereby causing the arms to deflect radially outwardly and to permit insertion of the lip of the neck past the tabs on the arms. Once the lip of the neck of the bottle is inserted past the tabs of the arms, the arms return toward their undeflected position, with the tabs positioned below the lip of the neck of the bottle, thereby retaining the neck of the bottle in the bottle neck receiving area and securing the bottle to the bottle carrier. Loaded bottle carriers can be stacked upon one another, with the bottles of one bottle carrier stacked on an upper surface of the base of another bottle carrier.

BRIEF DESCRIPTION OF THE DRAWINGS

Other advantages of the present invention can be understood by reference to the following detailed description when considered in connection with the accompanying drawings wherein.

DETAILED DESCRIPTION OF A PREFERRED EMBODIMENT

Figure 1:
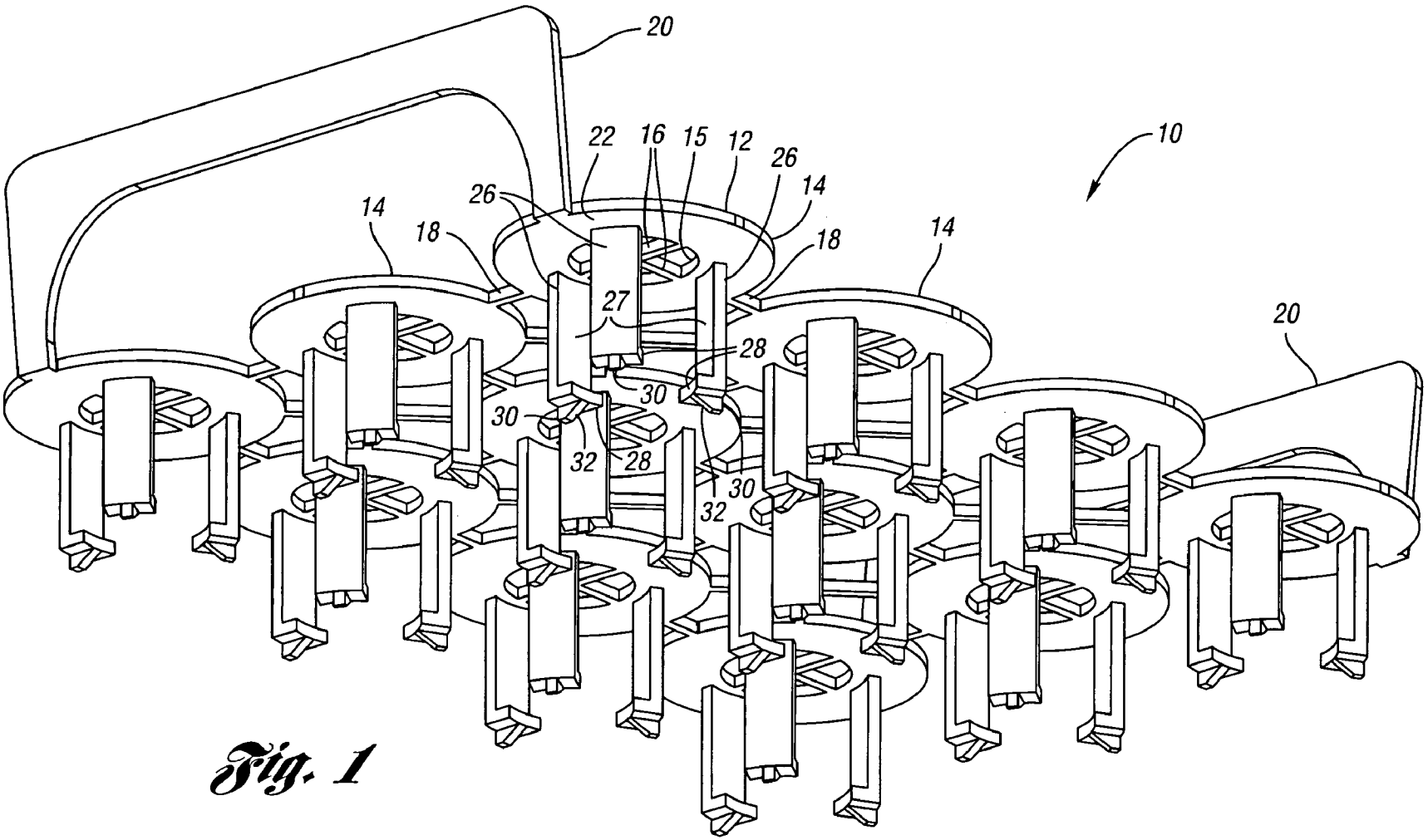
FIG. 1 is a perspective view of a bottle carrier according to the present invention.

A first embodiment of bottle carrier 10 is shown in FIG. 1 including a base 12 having a plurality of annular base portions 14 each defining an opening 15 which may have cross bars 16 extending therethrough. The annular base portions 14 are interconnected by bars 18. In this embodiment, handles 20 extend upwardly from opposite ends of the base 12.

A plurality of arms 26 extends downwardly from a lower surface 22 of each base portion 14. The arms 26 are circumferentially spaced about the annular base portion 14 and radially spaced from the opening 15. Each of the arms 26 is shown having a concave inner surface 27 substantially corresponding to the curvature of a circle defined among the plurality of arms 26.

A tab 28 extends radially inwardly from an outer (or lower) end of each arm 26. Each tab 28 includes a projection 30 protruding downward and having a lower surface 32 that angles away from the base as it extends away from the bottle receiving area. A bottle neck receiving area is defined below each base portion 14 among the plurality of arms 26.

Figure 2:
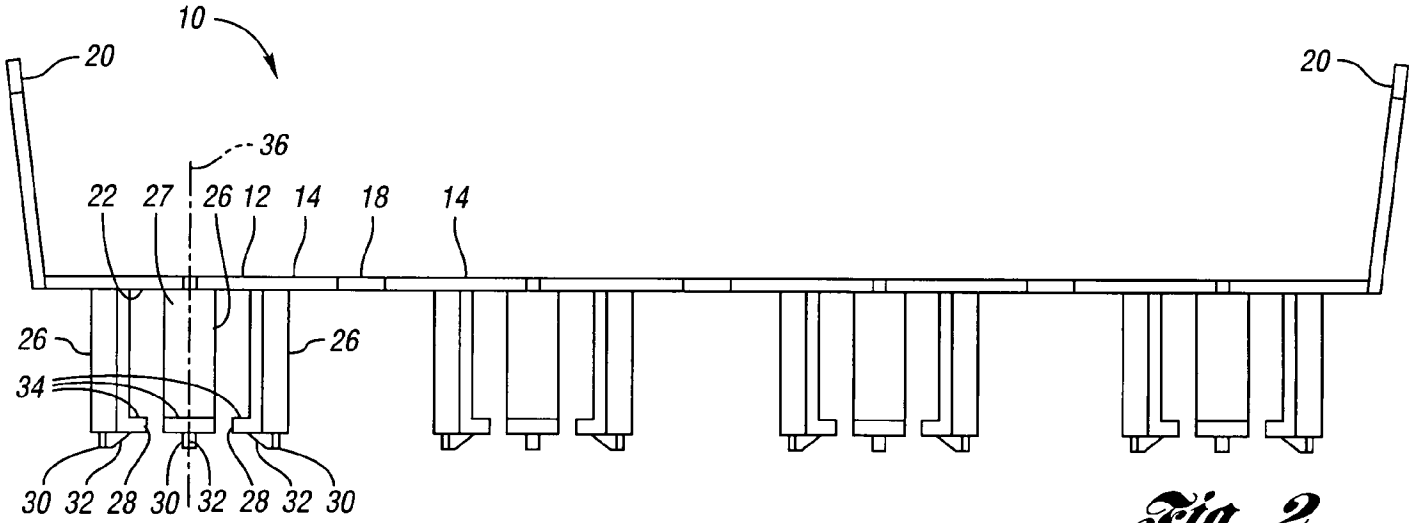
FIG. 2 is a side view of the bottle carrier of FIG. 1.
Figure 3:
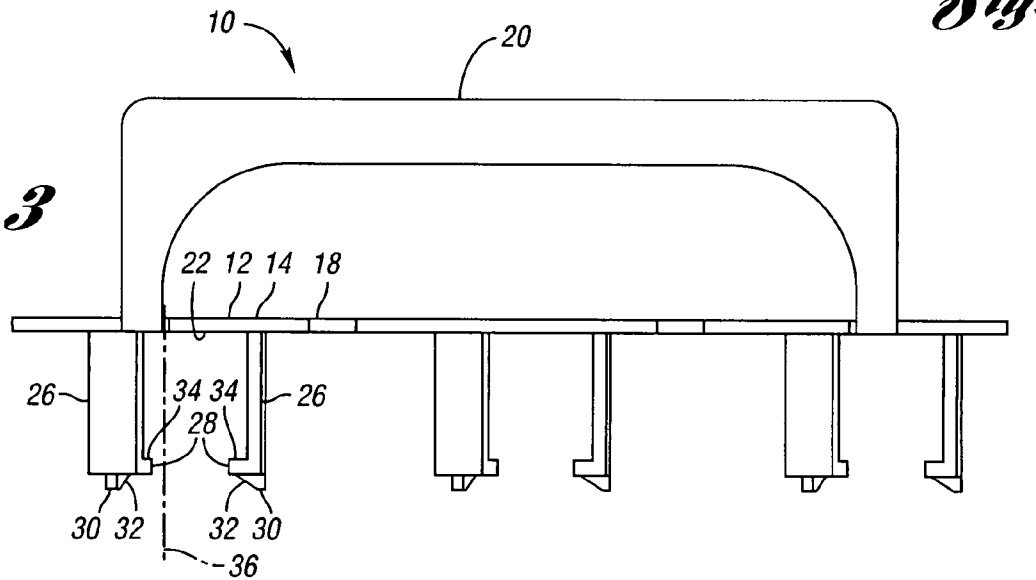
FIG. 3 is an end view of the bottle carrier of FIG. 1.

FIGS. 2 and 3 are a side view and an end view, respectively, of bottle carrier 10 of FIG. 1. As shown, each of the tabs 28 further includes an upper surface 34, generally coplanar with one another, for supporting a lip of a neck of a bottle. The plurality of arms 26 are equally distributed about an axis 36 of the base portion 14, thereby defining the bottle neck receiving area among the inner surfaces 27 of the arms 26 and between the lower surface 22 of the base portion 14 and the upper surface 34 of each of the tabs 28.

Figure 4:
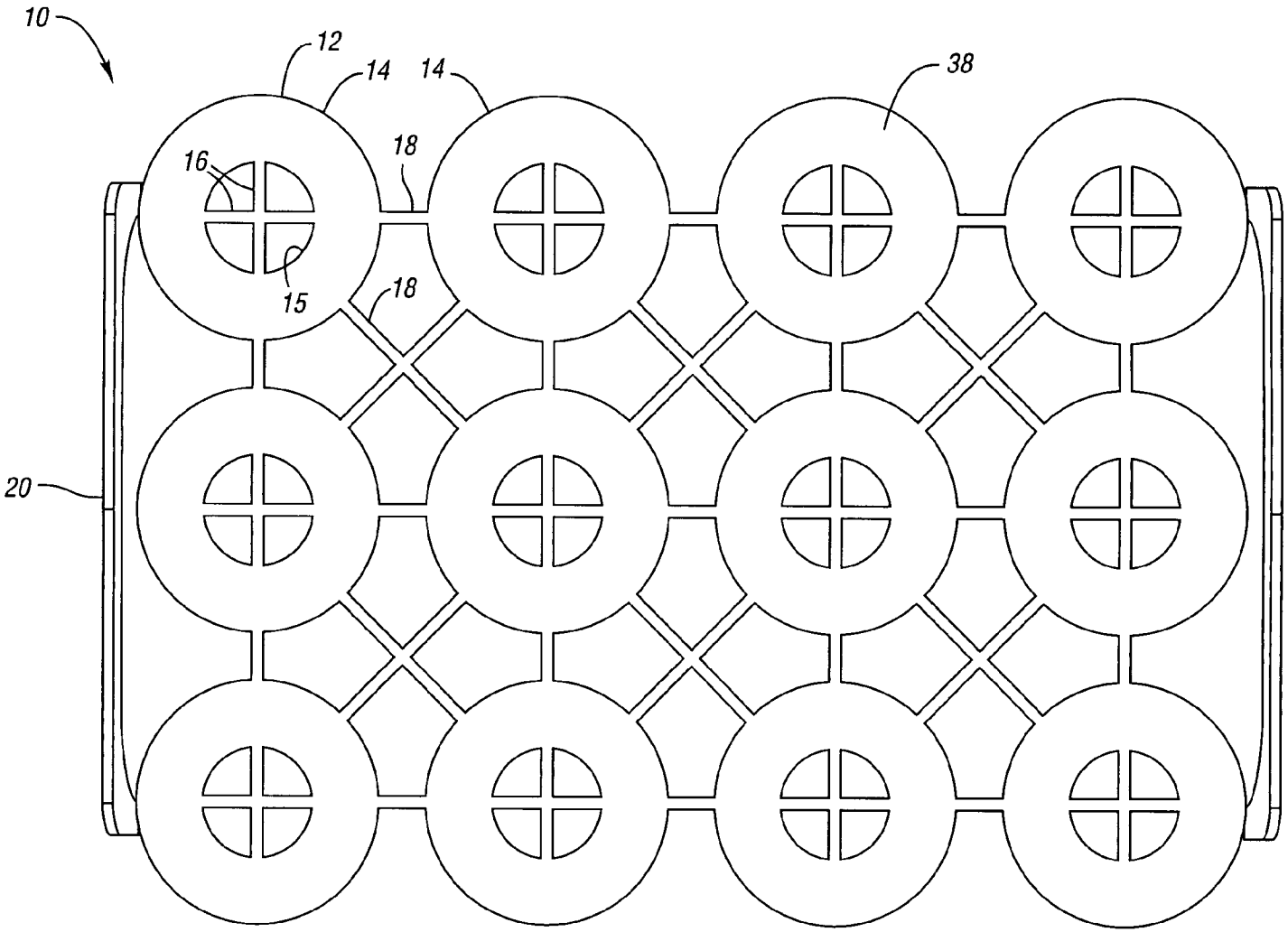
FIG. 4 is a top view of the bottle carrier of FIG. 1.

FIG. 4 is a top view of the bottle carrier 10. The base 12 includes an upper surface 38 for supporting a plurality of bottles thereon. Although not limited to this arrangement, in the embodiment shown, each of the annular base portions 14 would support a single bottle if bottles in a like carrier 10 were stacked thereon.

Figure 5:
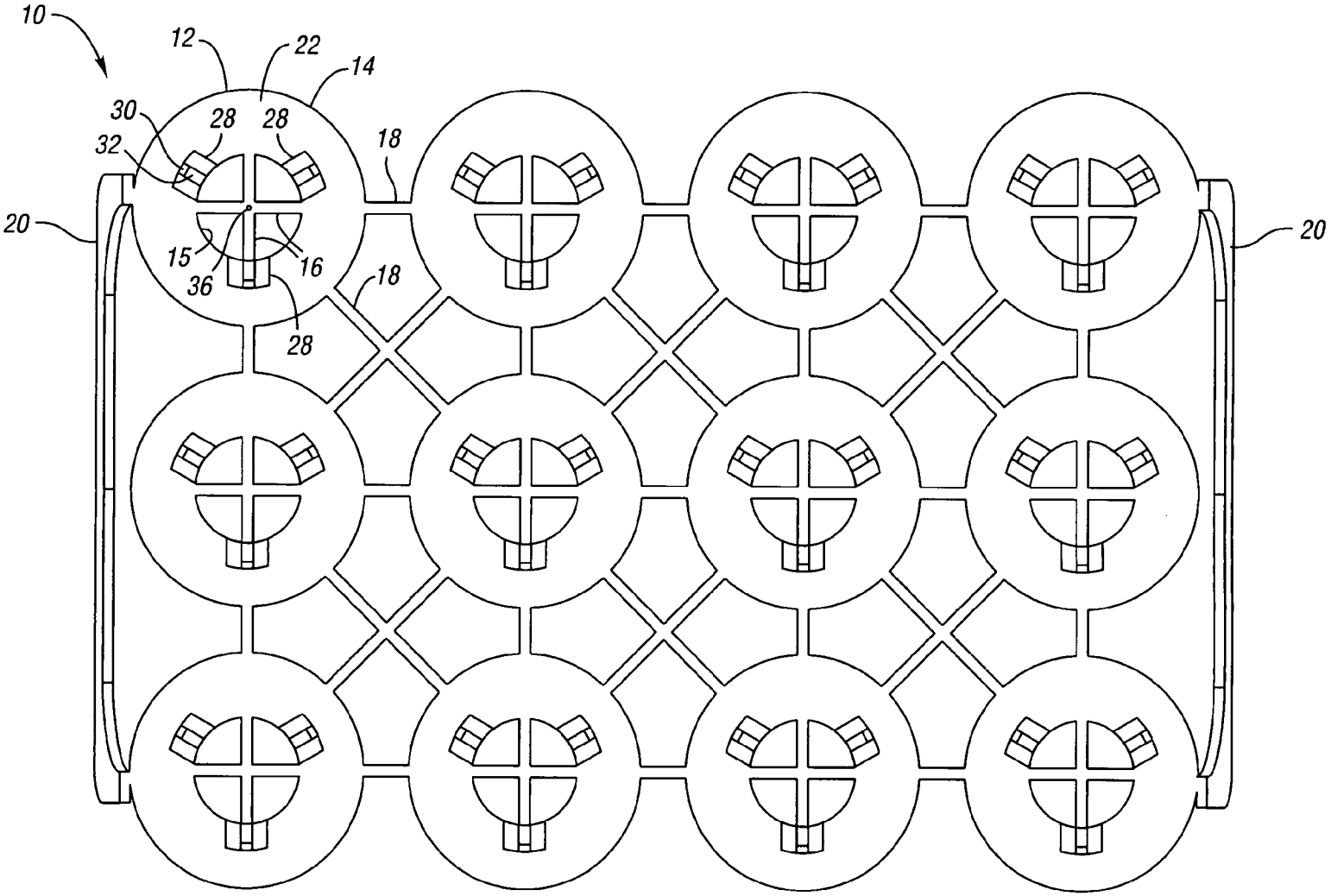
FIG. 5 is a bottom view of the bottle carrier of FIG. 1.

FIG. 5 is a bottom view of the bottle carrier 10. As shown, the plurality of arms 26, represented in this view by tabs 28, are circumferentially spaced about the opening 15 through the annular base portion 14. The plurality of arms 26 are also equally radially spaced away from the axis 36 of the bottle neck receiving area.

Figure 6:
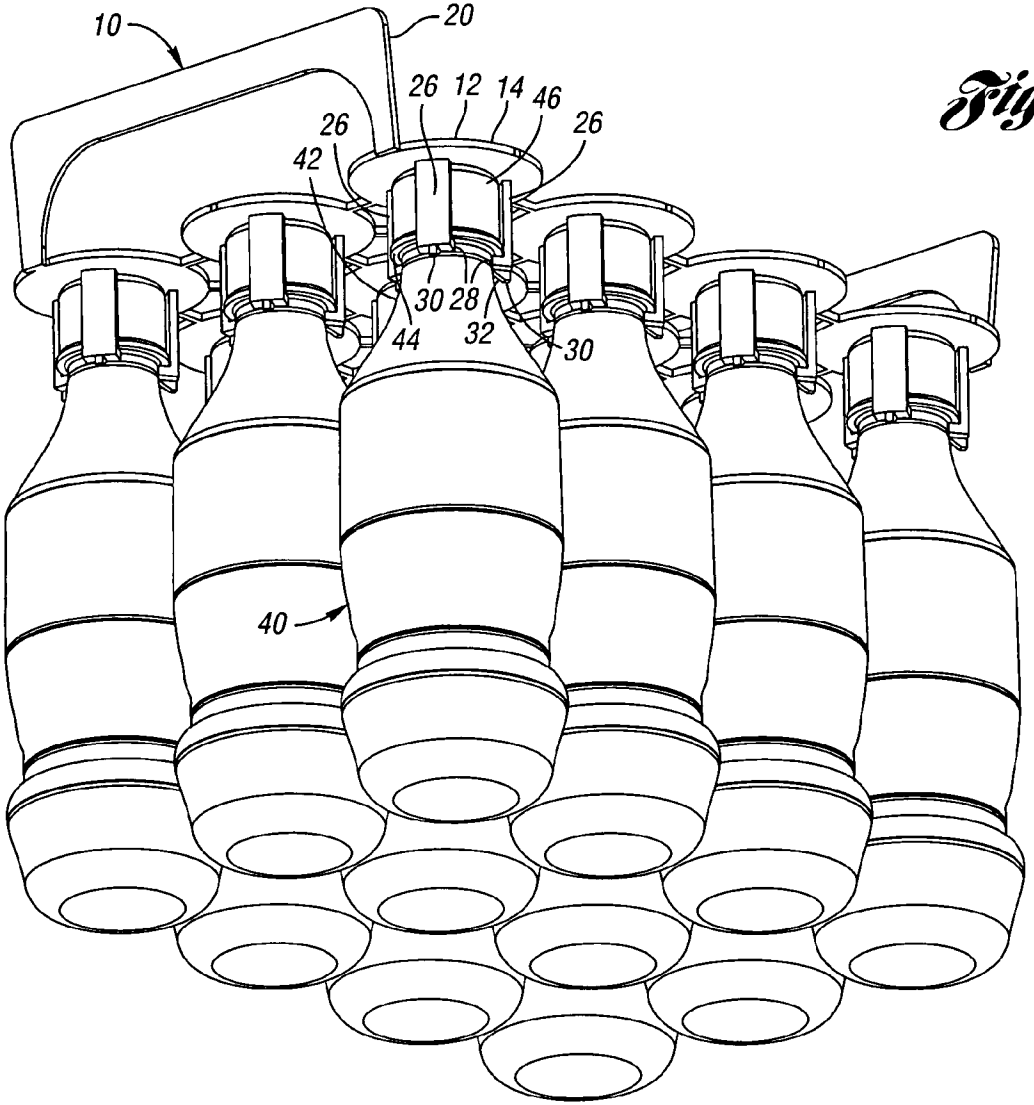
FIG. 6 is a perspective view similar to FIG. 1 of the bottle carrier of FIG. 1 shown carrying a plurality of bottles.

FIG. 6 illustrates the bottle carrier 10 carrying a plurality of bottles 40. Each of the bottles 40 includes a neck portion 42 having a lip 44 with a diameter larger than that of the remainder of neck portion 42. Above the lip 44, a bottle cap 46 is secured on the top of the neck portion 42 of the bottle 40. As shown in FIG. 6, each bottle neck receiving area receives a bottle cap 46 and lip 44 and the portion of the neck portion 42 above the lip 44. The bottle 40 is retained in the bottle neck receiving area by the tabs 28 on arms 26. The tabs 28 are positioned below the lip 44 thereby holding the lip 44 and bottle cap 46 and the portion of the neck 42 above the lip 44 in the bottle neck receiving area.

To load bottle carrier 10 with bottles 40, the bottles 40 are arranged substantially as shown in FIG. 6, with the axis of each bottle neck 42 substantially aligned with the axis of each bottle neck receiving area. The base 12 of bottle carrier 10 is then urged downwardly onto the bottles 40, such that the bottle caps 46 initially contact the angled lower surfaces 32 of each of the tabs 28. As the base 12 is urged downwardly, the angle of the lower surfaces 32 causes at least one, if not all, of the arms 26 to temporarily deflect outwardly away from the bottle 40 and away from the axis of the bottle neck receiving area until the lip 44 also contacts the surface 32 and urges the arms 26 additionally outwardly. When the lip 44 is inserted past the tabs 28, the arms 26 return toward their normal, undeflected position, with the tabs 28 now positioned below the lip 44. The arms 26 may return all the way to their undeflected position, or may optionally continue to exert some force on the neck portion 42 below the lip 44. In this manner, the lip 44 is retained by the tabs 28 in the bottle neck receiving area. The bottle carrier 10 can then carry the bottles 40.

Figure 7:
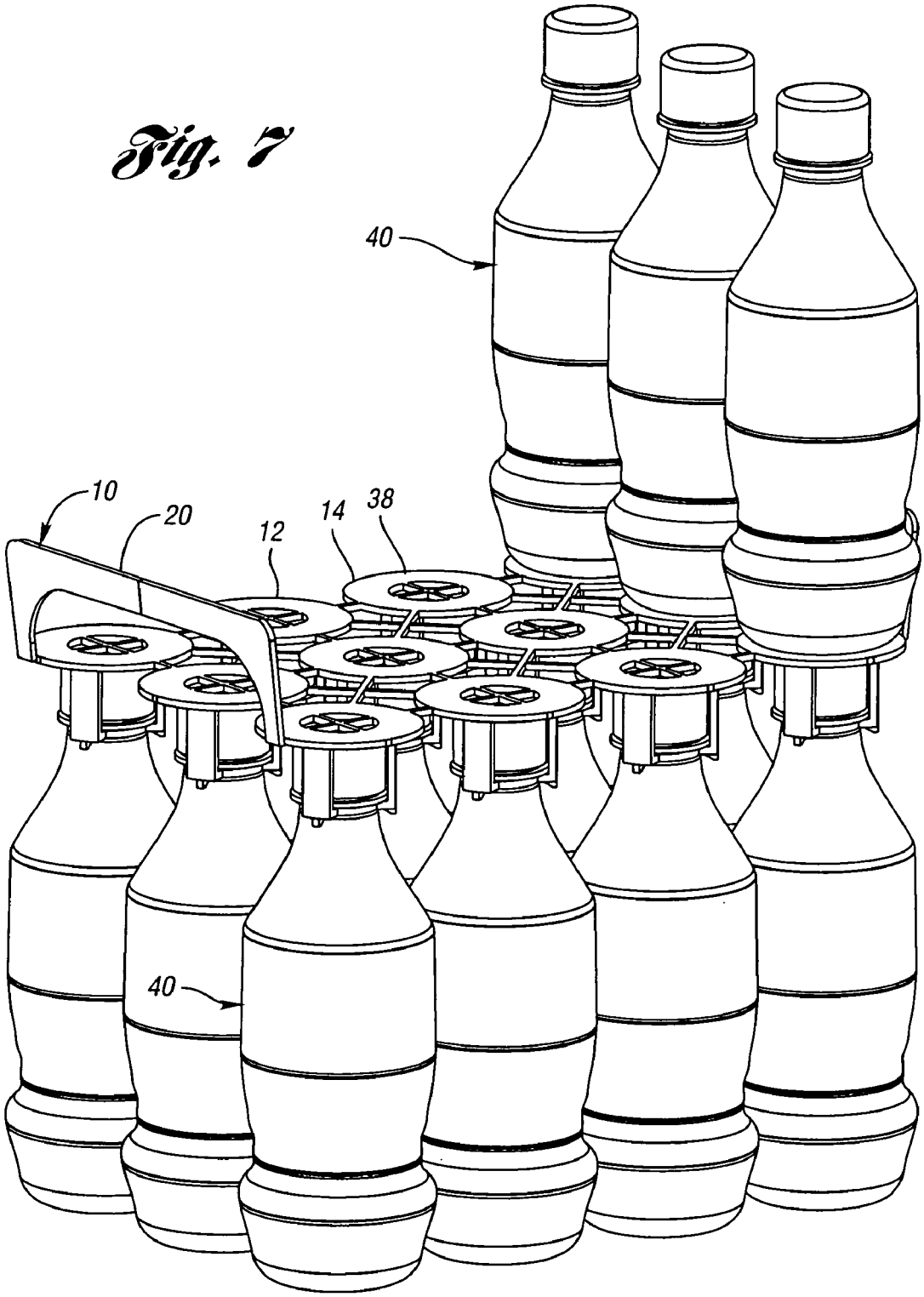
FIG. 7 is the bottle carrier and bottles of FIG. 6 with a plurality of bottles stacked thereon.

Additionally, as shown in FIG. 7, the upper surface 38 of the base 12 of the bottle carrier 10 can support a plurality of bottles 40. Although only three bottles 40 are shown in FIG. 7, it is expected that a bottle carrier similar to bottle carrier 10 and the bottles 40 loaded therein would be stacked on the upper surface 38 of the base 12 of the bottle carrier 10.

The bottles 40 can be stored, transported, and displayed to the end user on bottle carrier 10. Alternatively, the bottles 40 carried by bottle carrier 10 may be hung in a cooler by the handles 20 or otherwise for sale of individual bottles 40. To remove a bottle 40 from its bottle neck receiving area, the base of the bottle 40 is pulled in order to cant the axis of the bottle 40 relative to the axis of the bottle neck receiving area, such that the bottle cap 46 and lip 44 cause the arms 26 to temporarily bias outwardly, thereby releasing a lip 44 of the bottle 40 from the tabs 28 up deflection. When empty, the bottle carrier 10 can be returned for reuse.

Figure 8:
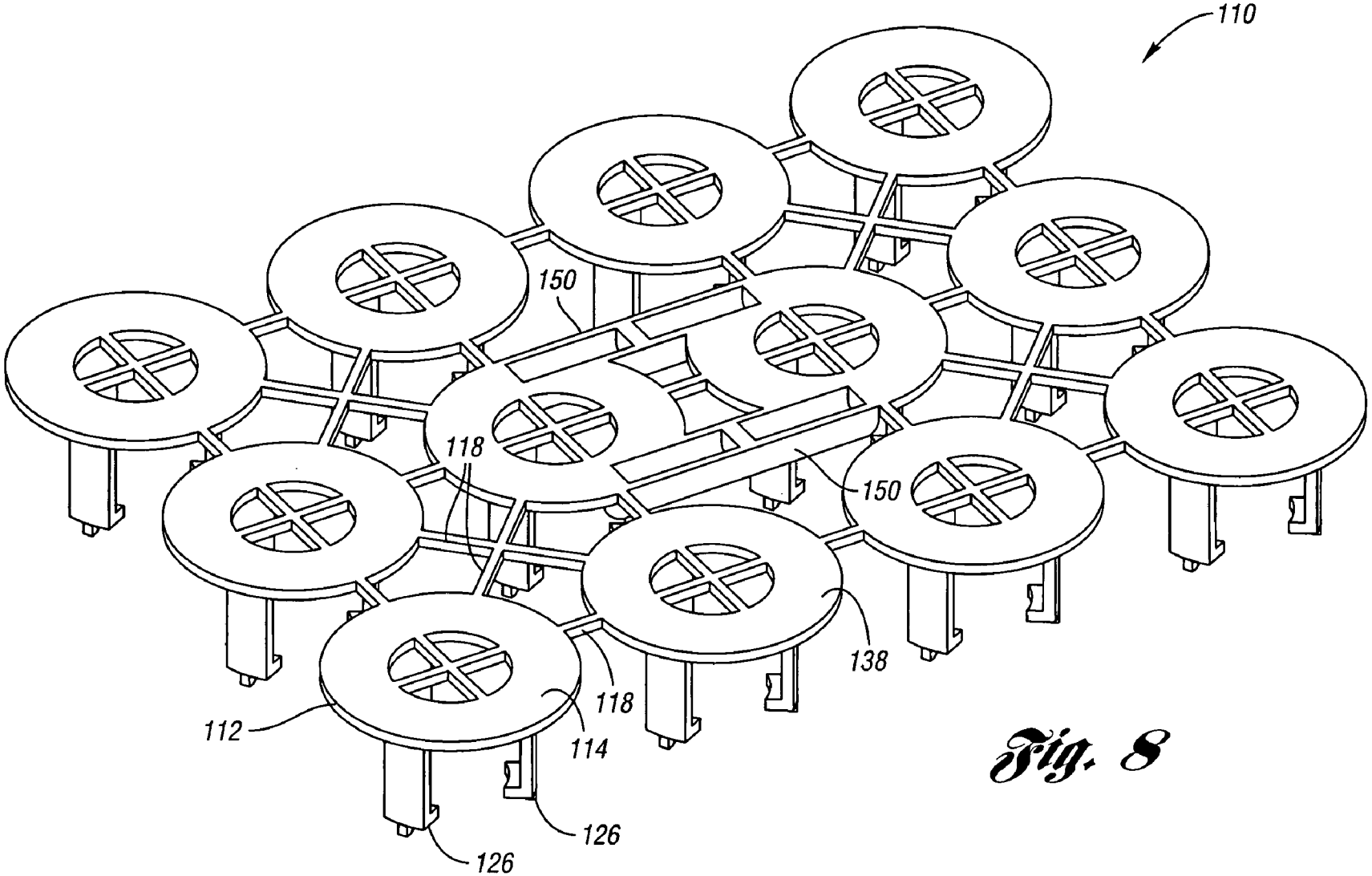
FIG. 8 is a top perspective view of a bottle carrier according to a second embodiment of the present invention.
Figure 9:
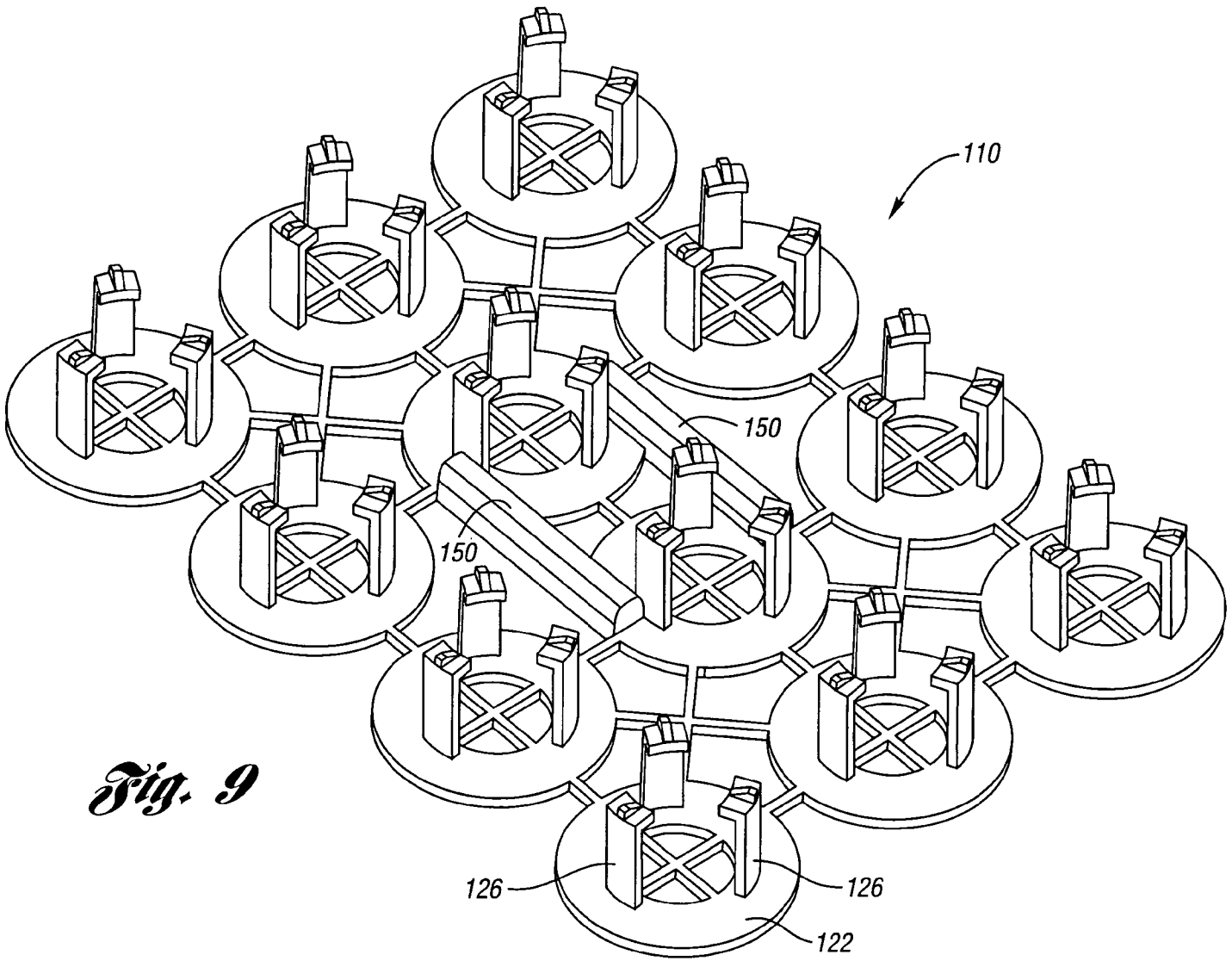
FIG. 9 is a bottom perspective view of the bottle carrier of FIG. 8.
Figure 10:
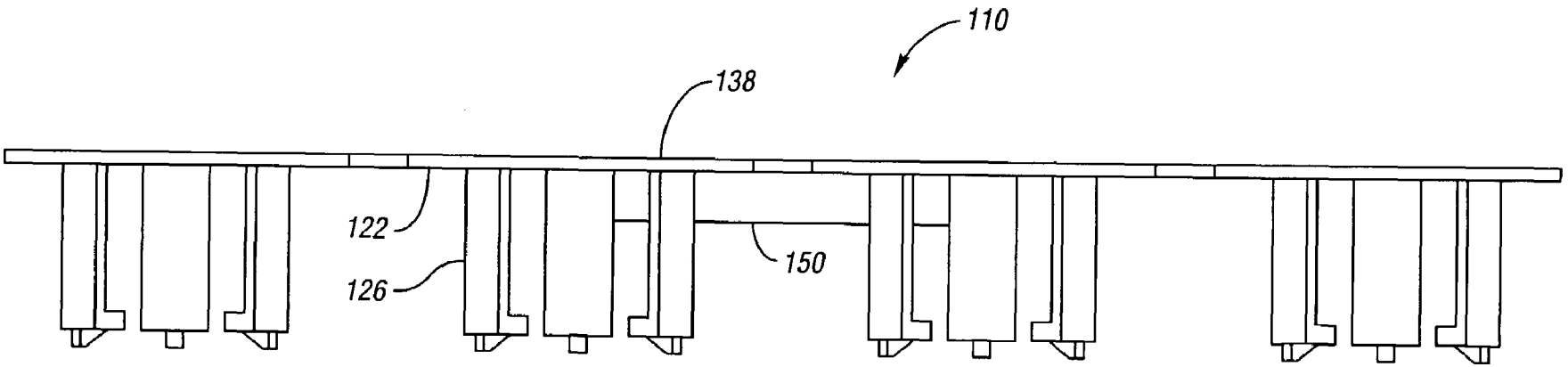
FIG. 10 is a side view of the bottle carrier of FIG. 8.

A bottle carrier 110 according to a second embodiment of the present invention is shown in FIGS. 8-10. Reference numerals of elements corresponding to like elements in the first embodiment include a prefix "1." Annular base portions 114 are interconnected by bars 118 to form the base 112. Arms 126 extend downwardly from the lower surface 122 of the base portions 114. In the bottle carrier 110 according to the second embodiment, the handles 150 are bars connecting the two center base portions 114. In this embodiment the upper surface 138 of the bottle carrier 110 is flat, without the protruding handles 20 of the first embodiment.

The bottle carrier 10, 110 may be formed polypropylene or other plastic material suitable for the specific application, via an injection molding process or other appropriate plastic manufacturing process. While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A bottle carrier and a plurality of bottles each having a neck having an axis, the bottle carrier comprising:

a base having a generally planar upper surface for supporting bottles thereon; and a plurality of bottle receiving areas defined below the base, each of the plurality of bottle receiving areas including at least one retaining member for contacting the neck of at least one of the bottles to retain the bottle in the bottle receiving area, the at least one retaining member extending downwardly from a lower surface of the base, and wherein movement of the base substantially parallel to the axes of the necks of the plurality of bottles causes the neck of each of the bottles to be received and retained in one of the plurality of bottle receiving areas by the at least one retaining member;

wherein the plurality of bottles each has its neck received with one of the bottle receiving areas, with the at least one retaining member of the bottle receiving area positioned below a lip on the neck of the bottle to retain the bottle to the bottle carrier.

2. The bottle carrier and plurality of bottles of claim 1 wherein the at least one retaining member is at least one arm extending down from the base to a free lower end, each arm at least partially defining one of the plurality of bottle receiving areas.

3. The bottle carrier and plurality of bottles of claim 1 wherein the at least one retaining member includes a plurality of arms each extending down from the base to a free lower end of the arm, the plurality of arms arranged about the axis of the neck of the bottle and contacting the neck of the bottle when the bottle is in the bottle neck receiving area to retain the bottle in the bottle carrier.

4. The bottle carrier and plurality of bottles of claim 1 wherein each arm deflects from a first position away from the bottle to a second position upon insertion of the bottle into the bottle receiving area, and wherein each arm returns toward the axis and toward the first position after insertion of the bottle into the bottle receiving area.

5. The bottle carrier and plurality of bottles of claim 4 wherein the base and arms are integrally molded as a one-piece unitary construction.

6. The bottle carrier and plurality of bottles of claim 1 wherein the base includes at least one handle extending upward from outer edges the base.

7. The bottle carrier and plurality of bottles of claim 1 wherein the at least one retaining member includes at least three retaining members and wherein each of the plurality of bottle receiving areas is defined by the at least three retaining members.

8. The bottle carrier and plurality of bottles of claim 7 wherein each of the at least three of the plurality of retaining members includes a tab having an upper surface for supporting a lip on the neck of the bottle, each tab projecting inwardly from its associated retaining member into the bottle-receiving area.

9. The bottle carrier and plurality of bottles of claim 8 wherein the tab projects inwardly from a lower free end of its associated retaining member.

* * * * *